US007587926B2

(12) United States Patent
Ackerman

(10) Patent No.: US 7,587,926 B2
(45) Date of Patent: Sep. 15, 2009

(54) METHOD AND APPARATUS FOR TESTING DETECTORS

(75) Inventor: Jack Ackerman, Itasca, IL (US)

(73) Assignee: HSI Fire & Safety Group, LLC, Elk Grove Village, IL (US)

( * ) Notice: Subject to any disclaimer, the term of this patent is extended or adjusted under 35 U.S.C. 154(b) by 130 days.

(21) Appl. No.: 11/653,184

(22) Filed: Jan. 12, 2007

(65) Prior Publication Data

US 2007/0186618 A1 Aug. 16, 2007

Related U.S. Application Data

(60) Provisional application No. 60/758,826, filed on Jan. 13, 2006.

(51) Int. Cl.
*G08B 17/10* (2006.01)

(52) U.S. Cl. ..... 73/1.02; 73/865.9; 340/514; 340/515; 340/628

(58) Field of Classification Search ..... 73/1.02, 73/1.03, 1.05, 1.06, 31.05, 170.04, 865.9, 73/864.41; 340/14, 514, 515, 516, 539.14, 340/539.26, 628, 630, 632; 43/127; 294/19.1; 374/1

See application file for complete search history.

(56) References Cited

U.S. PATENT DOCUMENTS 1,438,351 A * 12/1922 Ahern ..... 43/127
2,960,981 A * 11/1960 Robertson ..... 126/59.5
3,658,719 A * 4/1972 McConnaughey ..... 73/170.04
3,693,401 A * 9/1972 Purt et al. ..... 73/1.05
3,943,499 A * 3/1976 Dunphy ..... 340/514
4,271,693 A * 6/1981 Bute ..... 73/1.03
4,301,674 A * 11/1981 Haines et al. ..... 73/1.05
4,306,575 A * 12/1981 Minozzi, Jr. ..... 131/329
4,462,244 A * 7/1984 Lee ..... 73/1.05
D275,183 S * 8/1984 Minozzi, Jr. ..... D10/46
4,901,056 A * 2/1990 Bellavia et al. ..... 340/514

(Continued)

FOREIGN PATENT DOCUMENTS

EP 971328 A1 * 1/2000

(Continued)

OTHER PUBLICATIONS

Home Safeguard Industries, , "VT-ED8 Enclosed Delivery Test Kit", http://www.homesafeguard.com/ED8kit.htm, Dec. 2005.

(Continued)

*Primary Examiner*—David A. Rogers
(74) *Attorney, Agent, or Firm*—Ungaretti & Harris LLP

(57) ABSTRACT

An apparatus (10) for testing detectors has a cup or chamber (30) supported within a mid-cap (40) by a support ring (50). An adjustable cap (70) attaches at one end to a mid-cap (40) and at the other end to a step-adjust cap (80) via bayonet mounting. A handle (60) is pivotally connected to pivot pins (46) located on the mid-cap (40). An external ring (200) attaches to the distal rim (34) of the chamber (30) and has legs (202) for covering notches (35) formed in the chamber (30). An identifier reader or receiver/PDAs (500,516) is used in the system to communicate with the detector to identify the detector and/or transmit the test results to a central location.

20 Claims, 11 Drawing Sheets

U.S. PATENT DOCUMENTS

| | | | | | |
|---|---|---|---|---|---|
| 5,170,148 | A | * | 12/1992 | Duggan et al. | 340/515 |
| 5,309,148 | A | * | 5/1994 | Birk | 340/628 |
| 5,361,623 | A | * | 11/1994 | Wantz | 73/1.05 |
| 5,523,744 | A | * | 6/1996 | Wieser | 340/630 |
| 5,611,620 | A | * | 3/1997 | Wantz | 374/1 |
| 5,670,946 | A | * | 9/1997 | Ellwood et al. | 340/628 |
| 5,785,891 | A | | 7/1998 | Lim | |
| 5,959,188 | A | * | 9/1999 | Deutsch et al. | 73/1.06 |
| 6,015,230 | A | * | 1/2000 | Wantz et al. | 374/1 |
| 6,198,399 | B1 | * | 3/2001 | Mattis | 340/628 |
| RE37,255 | E | * | 7/2001 | Payne et al. | 340/524 |
| 6,282,940 | B1 | * | 9/2001 | Hung et al. | 73/1.06 |
| 6,420,973 | B2 | * | 7/2002 | Acevedo | 340/628 |
| 6,423,962 | B1 | * | 7/2002 | Pepper | 250/222.1 |
| 6,469,623 | B2 | * | 10/2002 | Pattok et al. | 340/516 |
| 6,591,716 | B2 | * | 7/2003 | Wantz | 81/53.1 |
| 6,640,608 | B2 | * | 11/2003 | Pepper et al. | 73/1.02 |
| 6,672,636 | B2 | * | 1/2004 | Kelly | 294/19.1 |
| 6,803,853 | B2 | * | 10/2004 | Schnedier et al. | 340/514 |
| 6,838,988 | B2 | * | 1/2005 | Lennartz et al. | 340/539.26 |
| 7,204,534 | B2 | * | 4/2007 | Kelly | 294/19.1 |
| 7,212,734 | B2 | * | 5/2007 | Pepper et al. | 392/379 |
| 7,275,411 | B2 | * | 10/2007 | Peng | 73/1.06 |
| 7,281,404 | B2 | * | 10/2007 | Peng et al. | 73/1.06 |
| 2002/0067276 | A1 | * | 6/2002 | Skaggs | 340/632 |
| 2002/0166361 | A1 | * | 11/2002 | Wantz et al. | 73/1.06 |
| 2003/0029279 | A1 | * | 2/2003 | Wantz | 81/53.1 |
| 2004/0050137 | A1 | * | 3/2004 | Hoppenworth | 73/1.06 |
| 2005/0204799 | A1 | * | 9/2005 | Koch | 73/1.06 |
| 2006/0081033 | A1 | * | 4/2006 | Peng | 73/31.05 |
| 2006/0101925 | A1 | * | 5/2006 | Peng et al. | 73/864.41 |
| 2008/0224847 | A1 | * | 9/2008 | Pepper | 340/514 |

FOREIGN PATENT DOCUMENTS

| | | | | |
|---|---|---|---|---|
| EP | 971329 | A1 | * | 1/2000 |
| GB | 2409319 | A1 | * | 6/2005 |
| JP | 11110657 | A | * | 4/1999 |
| JP | 2005250912 | A | * | 9/2005 |
| JP | 2006024064 | A | * | 1/2006 |
| WO | WO 03/067542 | A1 | * | 8/2003 |
| WO | WO 2006064190 | A1 | * | 6/2006 |
| WO | WO 2007138329 | A1 | * | 12/2007 |

OTHER PUBLICATIONS

Home Safeguard Industries, , "VT-Kit-1 Professional Test Kit", http://www.homesafeguard.com/VTkit1.htm, Dec. 2005.

Home Safeguard Industries, LLC, , "VT-ED16 Enclosed Delivery Test Kit", http://www.homesafeguard.com/ED16Kit.htm, Dec. 2005.

* cited by examiner

METHOD AND APPARATUS FOR TESTING DETECTORS

CROSS-REFERENCE TO RELATED APPLICATIONS

This application claims priority from U.S. Provisional Patent Application No. 60/758,826, filed Jan. 13, 2006, currently pending, which is herein incorporated by reference.

TECHNICAL FIELD

The present invention relates to testing detectors, such as smoke detectors and carbon monoxide detectors, and more particularly, to an improved device used for testing such detectors and the method of using the device.

BACKGROUND OF THE INVENTION

Smoke detectors and carbon monoxide detectors are now commonly used in homes and schools and industrial and commercial facilities. They are frequently mounted to posts, ceilings or walls to alert an alarm for occupants and visitors when either smoke is detected or elevated levels of carbon monoxide are detected. To test such detectors for service or maintenance, a testing device or test dispenser is used. The prior art testing device for testing smoke or carbon monoxide detectors are often inadequate to reach detectors mounted in high elevated places on walls and ceilings in factories and large office buildings while the operator of the testing device is standing on the ground floor of the factory or office building having the high walls and ceilings.

The testing systems commonly used are either called an "open delivery system" or a "enclosed delivery system." In an "enclosed delivery system," the environment around the detector is controlled or enclosed, namely closed to everything but the detector and the testing materials. The testing chamber generally tries to cover the detector being tested so that the testing material may be applied in the chamber (and not the environment surrounding the chamber) to test the detector. Alternatively, in an "open delivery system," a chamber is not used. Instead, the testing material is applied around the detector's environment, namely the open space around the detector. For many reasons, the enclosed delivery system is required in some environments.

In the enclosed delivery system, the testing chamber generally encloses the detector to be tested and provides a controlled space or chamber for accepting the detector. For example, the tester is placed against a wall or ceiling supporting the detector. As such, for testing purposes, the environment surrounding the detector is controlled. Extraneous materials in the surrounding environment are generally prevented from entering the testing chamber during testing. Associated with the test chamber is the material, such as an aerosol canister with the testing material or substance therein, used to perform the test. This testing material in the canister is generally directed at the detector to be tested in some fashion. As a result, the testing material within the canister is generally released directly into the test chamber to test the detector.

Another common problem with prior art testers is getting the testing device to seal properly against the wall or ceiling of a detector mounted at high elevations without breaking the seal on the enclosed delivery system.

HSI Fire and Safety Group LLC, Elk Grove Village, Ill. sells successful and popular testing devices made in accordance with the present invention under the trademark VERSA-TOOLS™. The VERSA-TOOLS™ kits include an aerosol test dispenser or canister, a telescoping test pole (e.g., 8 feet or 16 feet), an adapter pole for additional reach, and an equipment bag. The poles are durable, lightweight, non-conductive fiberglass.

Some testing materials, provided in aerosol form, include the Smoke Detector Tester™ dispenser or canister which specifically tests both photoelectric and ionization smoke detectors to ensure that the circuitry, alarm and power is functioning and that they are actively sampling the air for any hint of smoke. The patented formulation simulates the entire range of fire conditions giving one the confidence of knowing the fire alarm system will respond promptly to all fire conditions. The Smoke Detector Tester™ Plus, which was designed to be 100% non-flammable for hospitals, clean rooms, etc. and is similar to Smoke Detector Tester™ aerosol. Both of these products are approved for testing smoke detector function per NFPA 72 par. 8-2.4.1 when used as directed.

It is appreciated that other testing materials are available on the market in other forms besides aerosol cans or canisters, etc.

One significant problem with other prior art testing devices is that detectors commonly have external electrical wires to and from them. These wires are typically enclosed in a standard metal conduit (e.g., 1 inch or 1½ inches diameter conduit), respectively. If the electrical conduit is within a wall or behind a ceiling, it is not an issue for testing the detector. However, if the conduit runs outside, or external, the wall or ceiling along or against the external surface of the wall or ceiling supporting the detector, it can cause a problem in having a sealed testing chamber environment. Because rims on most testing chambers are usually planar, the rims cannot abut against the support surface, e.g., wall or ceiling, to form a tight seal with the wall or ceiling as the conduit gets in the way. One or more large gaps are formed between the support surface or conduit and the rims of the chambers. Consequently, performing a test in an enclosed delivery system is difficult or impossible. This can significantly detract from the effectiveness of the test. In short, the test becomes more akin to an open delivery system type test.

Another issue arising is that testing materials, and more particularly, aerosol canisters, of different sizes are available on the market. As such, one having a test kit may be limited to the brand, manufacturer and/or size of canisters useable for the test. This can cause problems to the operator as s/he may not be able to switch canisters should the canister designed for the kit become unavailable, too pricey or simply outdated (when better test materials become available or when different formula for the materials within the canister are desired/necessary).

Yet another problem in buildings with numerous detectors mounted on high ceilings such as in a factory setting is to make sure that each detector is tested on a routine schedule to ensure the proper operation of the detectors. Thus the apparatus of the present invention is able to identify the detector and then to make a record of each test conducted on the detector in question. The apparatus is further capable of communicating the data concerning the identification of the detectors tested and the results of the tests to a central location.

Another factor is that detectors come in different sizes so it may be necessary to have the testing chamber enlarged to accommodate the larger detector during the closed system test. The apparatus of the present invention includes the ability to extend the size of the testing chamber through the means of fixedly attaching an extender or extension to the original testing chamber.

The invention of the present disclosure is a test device that addresses these just noted issues or limitations, along with others. It can accommodate detectors of various sizes having external electrical conduits running into and out of them and aerosol cans with testing material of different sizes.

Other advantages and aspects of the present invention will become apparent upon reading the following description of the drawings and the detailed description of the invention.

BRIEF DESCRIPTION OF THE DRAWINGS

To understand the present invention, it will now be described by way of example, with reference to the accompanying drawings in which.

DETAILED DESCRIPTION OF THE INVENTION

Figure 1:
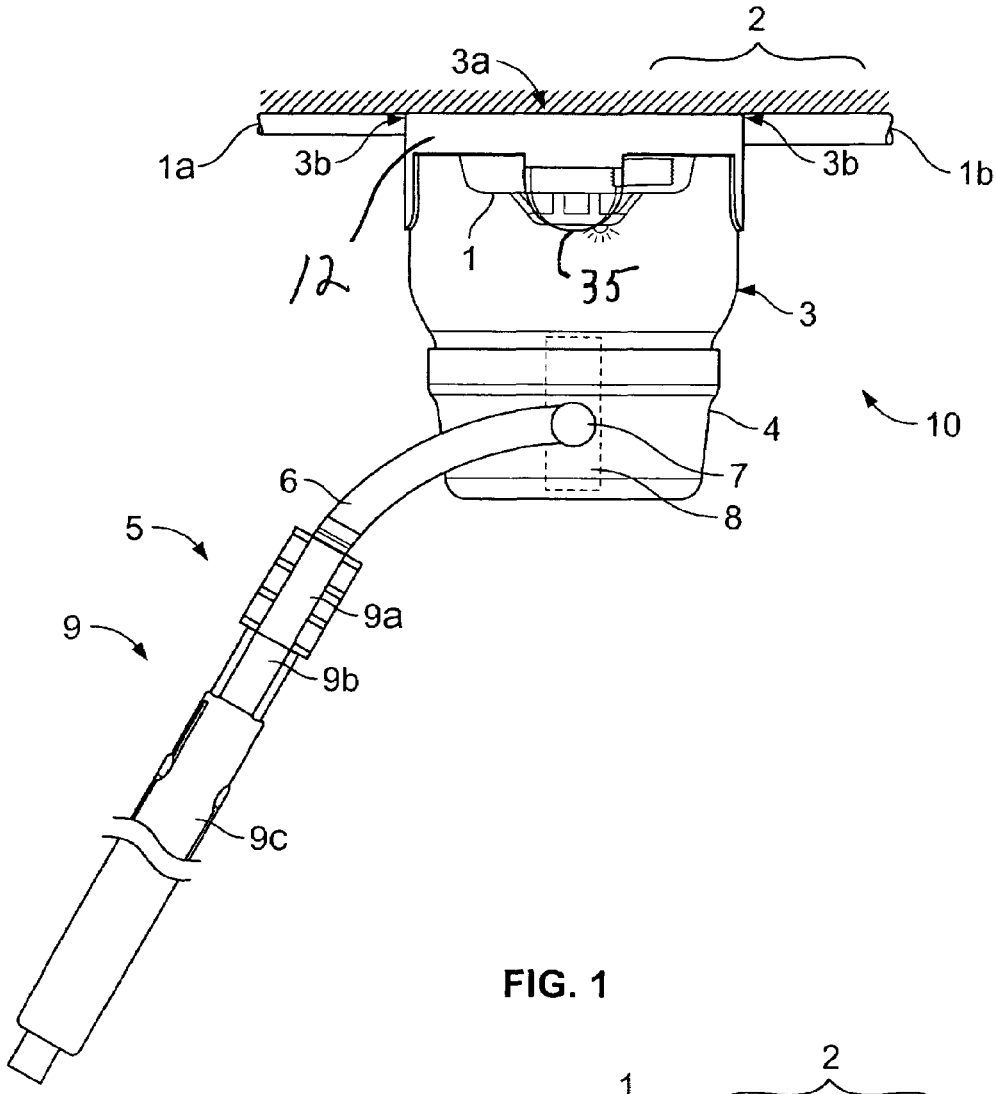
FIG. 1 is a side elevation view of a typical apparatus used for testing detectors.

While this invention is susceptible of embodiments in many different forms, there is shown in the drawings and will herein be described in detail, preferred embodiments of the invention with the understanding the present disclosure is to be considered as an exemplification of the principles of the invention and is not intended to limit the broad aspect of the invention to the embodiments illustrated.

FIG. 1 shows the apparatus 10 in general for testing a detector 1 mounted to a high ceiling location 2. The apparatus 10 includes a testing chamber 3 having an opening 3*a* fitting over the detector 1, a rim 3*b* on its distal end that secures against the ceiling 2 to form the closed testing or delivery system. A holder 4 for receiving various sized aerosol canisters 8 having the testing material therein is connected to the test chamber 3. A handle 5 includes a section 6 that is pivotally attached to the holder 4 and where the ceilings are located high above the ground floor, a pole 9 is inserted into the handle 5 to extend the reach of the operator to test the detectors mounted high up upon a wall or ceiling 2. The pole 9 may consist of a number of telescoping extensions 9*a*, 9*b* and 9*c* or individual extensions of varying length to reach detectors 1, which are located a predetermined height above the ground floor or surface. The pole 9 and any extensions 9*a*, 9*b* or 9*c* are generally made out of durable, lightweight, non-conductive fiberglass or any other similar non-conductive material.

Figure 2:
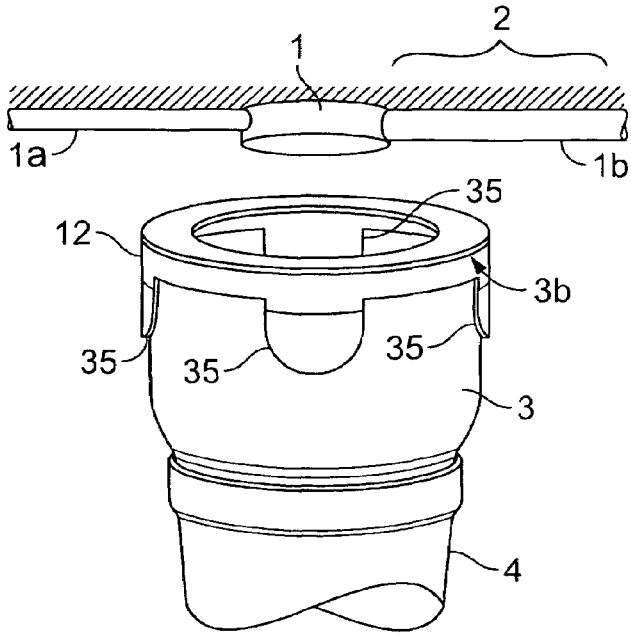
FIG. 2 is a perspective side view of a problem associated with using the apparatus of FIG. 1 when an external electrical conduit is connected to a detector.

FIG. 2 shows the chamber 3 attempting to cover a detector 1 where the detector 1 is connected to a power source through a 1" conduit 1*a* or through a 1½" conduit 1*b* externally mounted to the ceiling. In this case, the chamber 3 includes notches 35 in the rim 3*b*, which are both covered by an elastic and deformable material 12 to fit over the conduit and still achieve a seal of the chamber 3 against the wall or ceiling to be discussed in greater detail later in FIGS. 3A, 3B, 11A-C, 13 and 14. Referring back to FIG. 1 the rim 3*b* of the test chamber 3 is flat against the ceiling 2 to form a sealed environment for testing the detector 1 having the conduits 1*a*, 1*b* deforming the material 12 while the conduits are recessed into the opposing notches 35.

The general juxtaposition and orientation of the components associated with the apparatus 10 of the present invention are as follows. The assembly includes a cup or chamber 30 supported within a mid-cap 40 by a support ring 50 communicating with both components. The adjustable cap 70 attaches at one end via internal screw threads to the external screw threads of mid-cap 40 and at the other end, to the step-adjust cap 80 via bayonet mounting. A handle 60 is pivotally connected to pivot pins 46 located on the mid-cap 40. The external ring 200 attaches to the distal rim 34 of the chamber 30. An inner support 400 sits within the step-adjust cap 80 to support the testing material, such as an aerosol canister 8 of various sizes with testing materials/substance therein. Additional rings 100 and 300 are used within the apparatus to act as gaskets or seals.

The Cup or Chamber 30

Figure 3A:
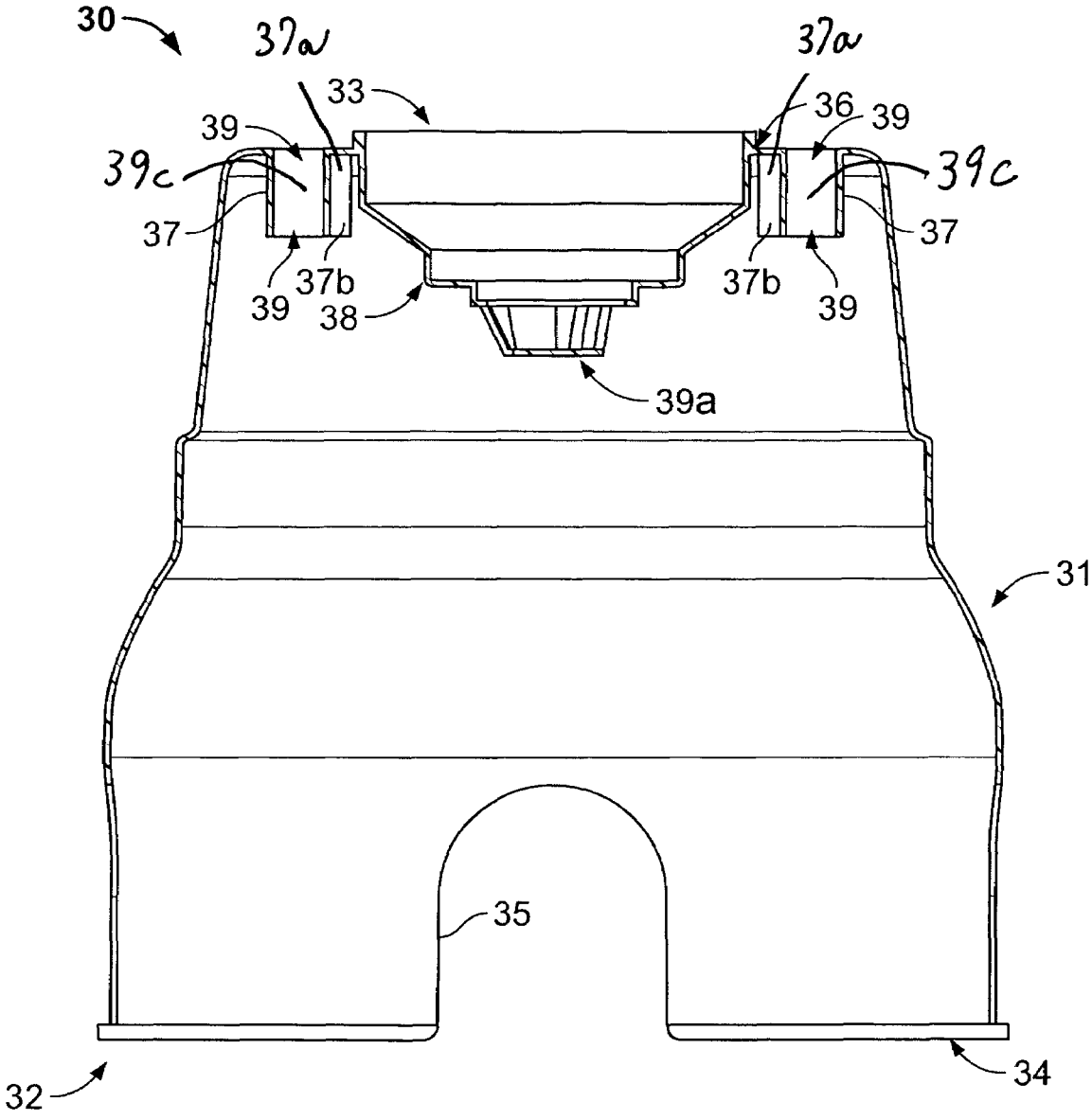
FIG. 3A is a side sectional view of a cup or chamber made in accordance with the teachings of the present invention.
Figure 3B:
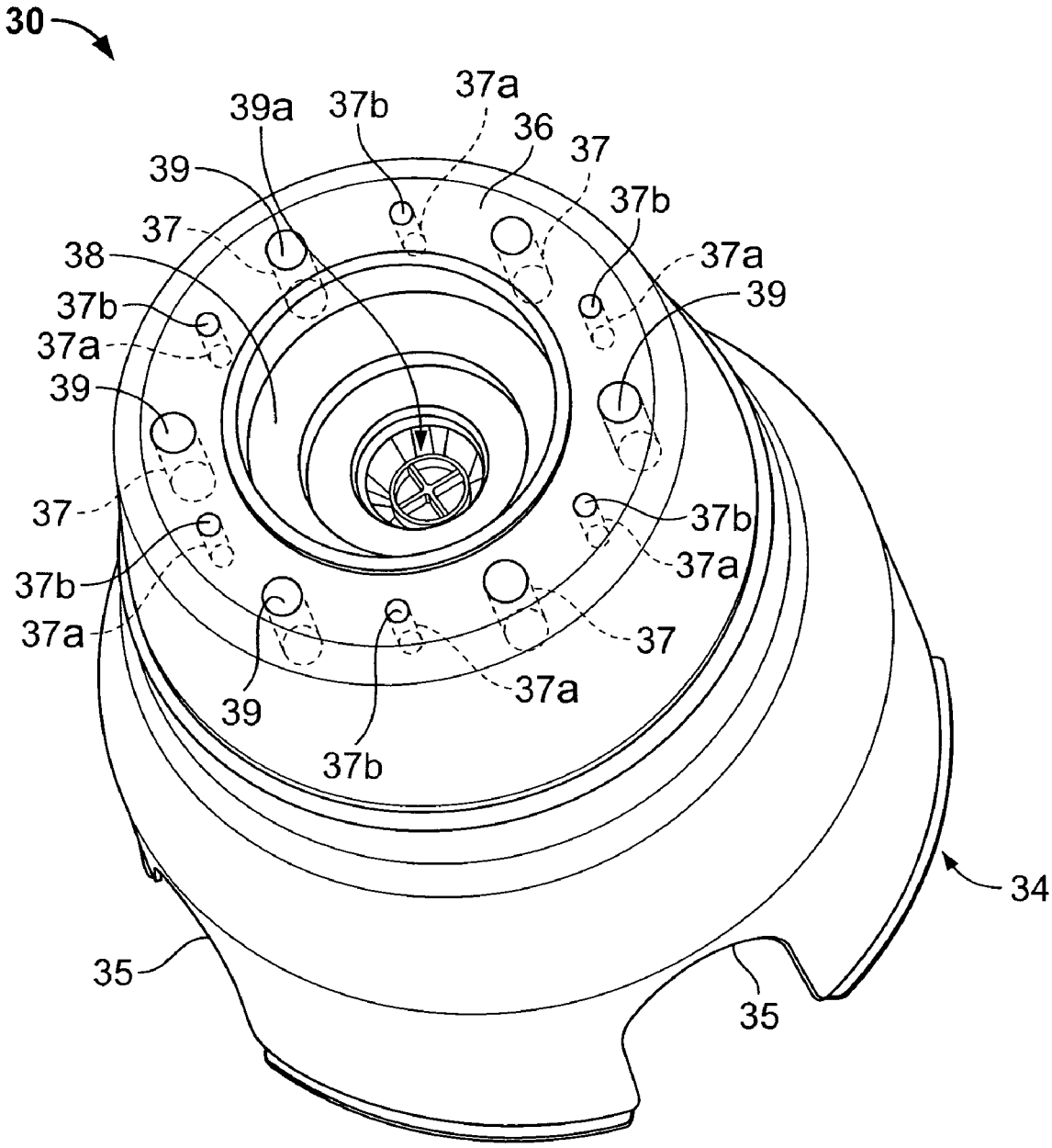
FIG. 3B is a top perspective view of the cup or chamber of FIG. 3A.

Referring now to FIGS. 3A and 3B, a cup or chamber 30 has a generally frustoconical side wall 31 and has two ends 32, 33. One end, the distal end 32 is open, having a rim 34 with a plurality of notches 35 therein. These notches 35 are spaced 90 degrees from one another and sized so as to accommodate 1 inch to 1½ inch electrical conduit (1*a* or 1*b*, respectively in FIGS. 2 & 13). In this manner, the cup 30 can be placed over a detector 1 in FIGS. 1, 2 and 13 such that the rim 34 abuts the ceiling or wall 2 while either conduit 1*a* or 1*b* runs through opposing notches 35. The conduit runs in one notch 35, through the chamber 30, and out the opposing notch 35. Four notches 35 are provided as a detector can have different combinations of conduit connected thereto. For example, conduit can be connected to the detector at 90 degrees, 180 degrees and 270 degrees.

At the material end 33 of the testing chamber 30 is a generally planar base 36 having a plurality of inwardly projecting hollow posts 37 and 37*a* of approximately the same height with openings 39 on either end of posts 37 defining a passage 39*c* therethrough and with openings 37*b* at the distal end of posts 37*a* for receiving a fastener such as a threaded screw therein and having the other end adjacent the base 36 closed. The base 36 includes a stepped or tiered wall 38 projecting inwardly therefrom. The tiered wall sections 38 terminate in a cage area 39*a* (with cross members and an opening) for seating on the top of an aerosol canister held within the test device 10. The chamber 30 is preferable translucent or transparent so that one can see through the chamber walls at the detector during set-up, testing and removal.

Figure 13:
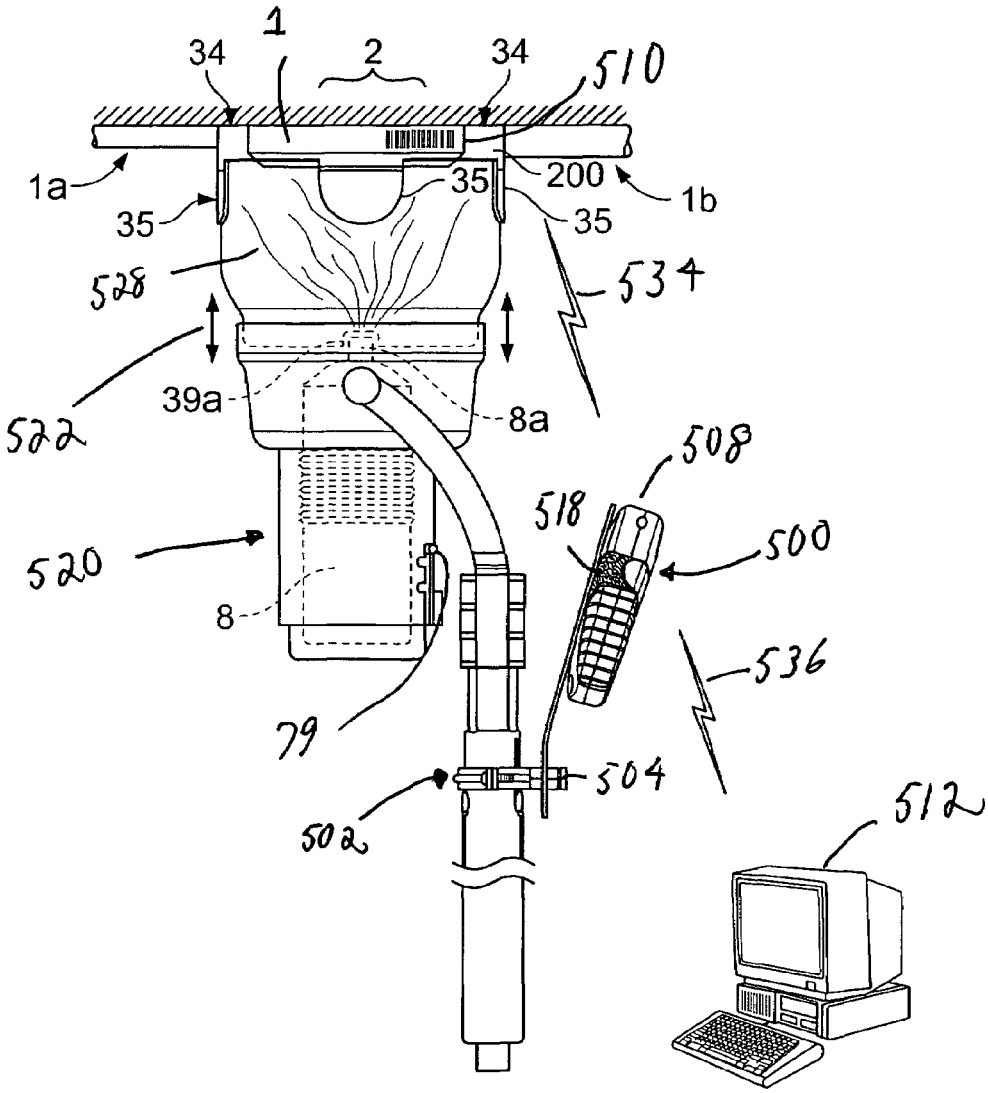
FIG. 13 is a schematic view of the apparatus of the present invention in operation with a sensor for identifying and recording the results of the detector being tested.
Figure 14:
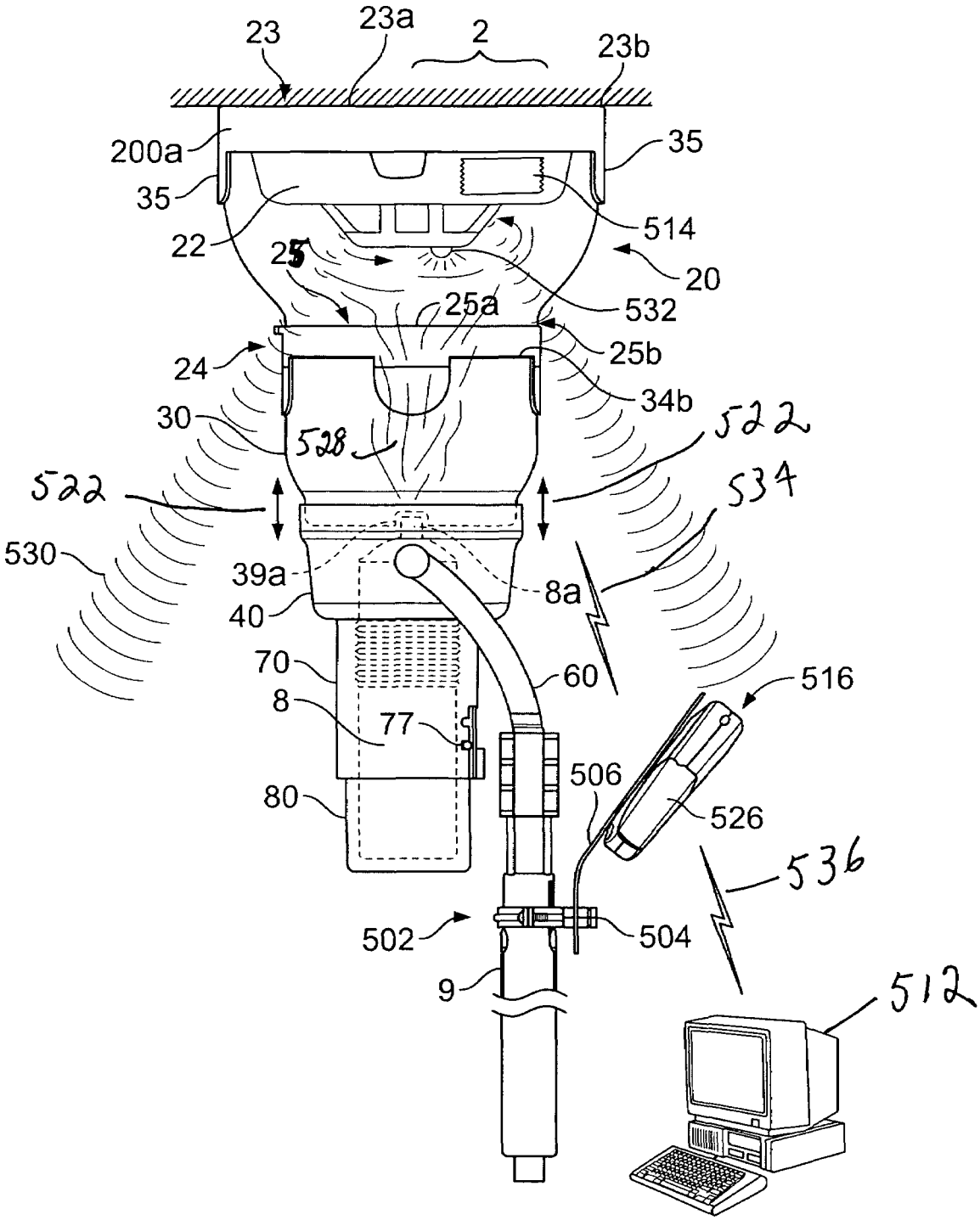
FIG. 14 is a schematic view of the apparatus of FIG. 1 showing an enlarged chamber to test larger detectors and a sensor for identifying and recording the results of the detector being tested.

Now some new detectors are larger in size requiring a larger testing cup or chamber 20 (see FIG. 14). An extension or extender cup or chamber 20 will to be used to test larger detectors 22, which will be briefly described here but in greater detail later when referring to FIG. 14. The rubber ring 200 is removed from the rim 34 of the cup 30 (forming the test chamber 30) before the extender cup or cone 20 is placed over the rim 34 of the original cone 30. The extender cone or chamber 20 is made of a similar plastic material and grips or mounts on top of the distal end or rim 34 of the original cone 30. The chamber or translucent cup 3 of FIGS. 1 and 2 and cup 30 of FIG. 3 can be modified to introduce the larger cup 20 in conjunction and cooperation with a converter 24 (made of a softer plastic or rubber material than cups 20 or 30) to allow the larger cup extension or cone 20 to be attached to the existing cup or cone 30 for testing larger detectors 22 within an enclosed delivery system or testing chamber. This new embodiment creates a larger enclosure with same cutout plugs or notches 35 to enable the unit to address the issue of externally mounted conduits feeding power to the detectors in factories and other buildings where the mechanicals and electrical systems are exposed and easily accessible for maintenance proposes as shown in FIGS. 2 & 13.

The Mid-Cap 40

Figure 4A:
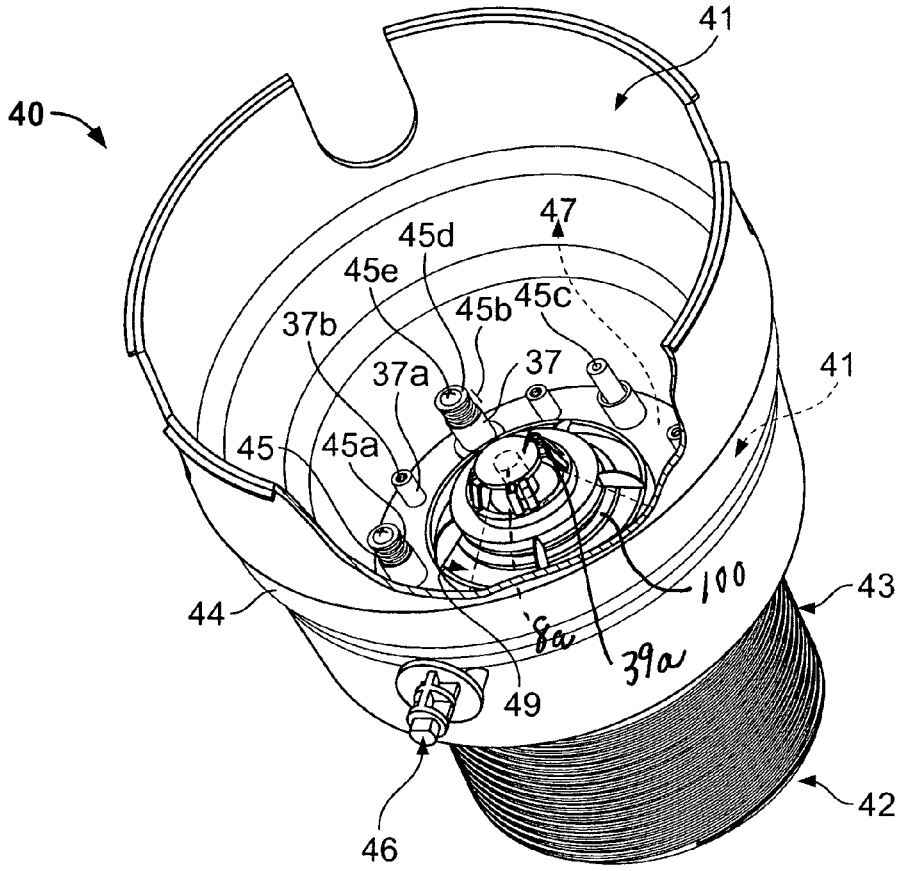
FIG. 4A is a top perspective view of a mid-cap made in accordance with the teachings of the present invention.
Figure 4B:
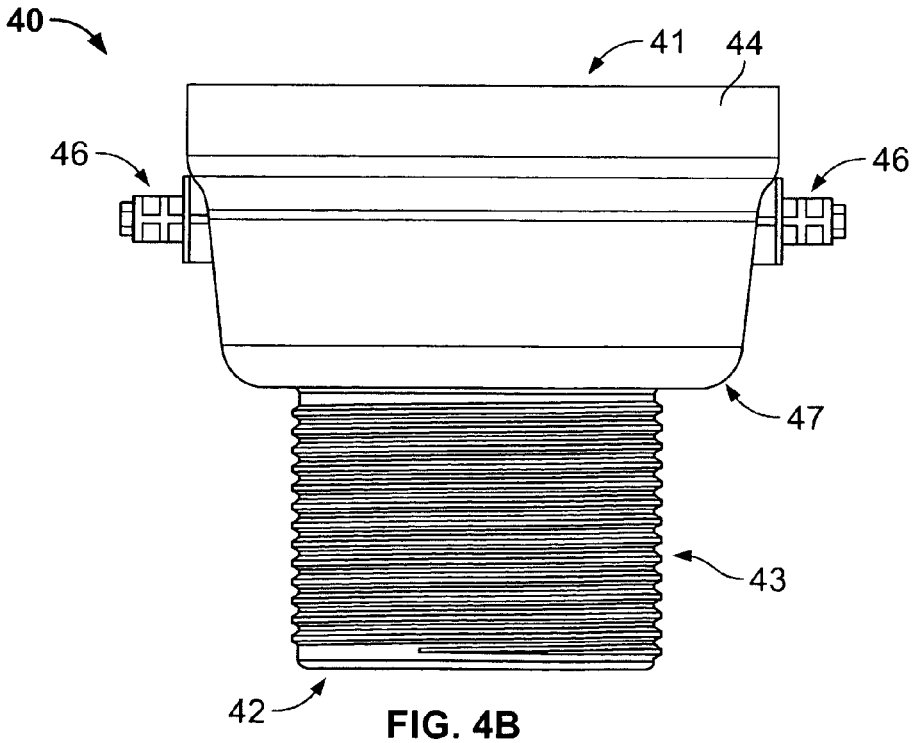
FIG. 4B is a side elevation view of the mid-cap of FIG. 4A.
Figure 5:
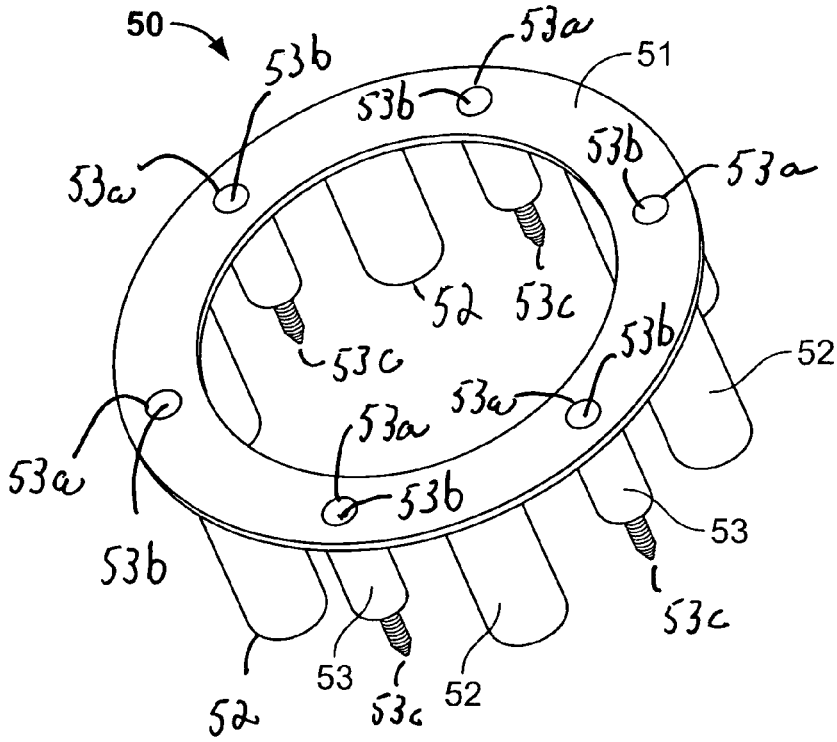
FIG. 5 is a perspective view of a support ring made in accordance with the teachings of the present invention.
Figure 6A:
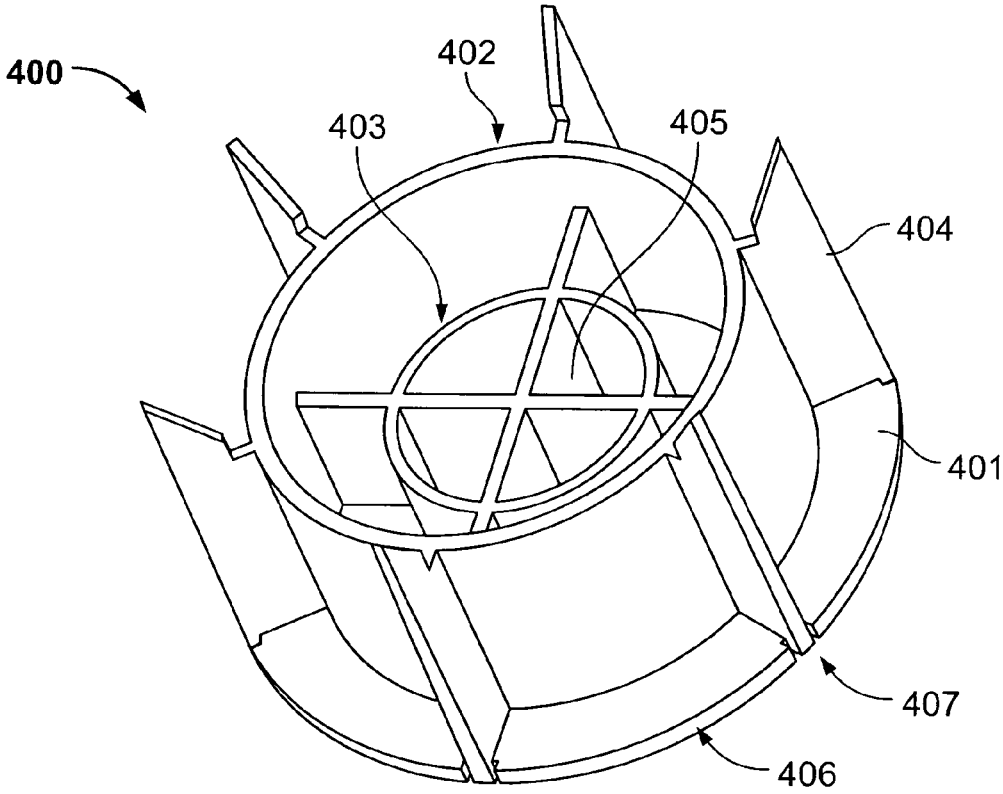
FIG. 6A is a perspective view of an inner support made in accordance with the teachings of the present invention.
Figure 6B:
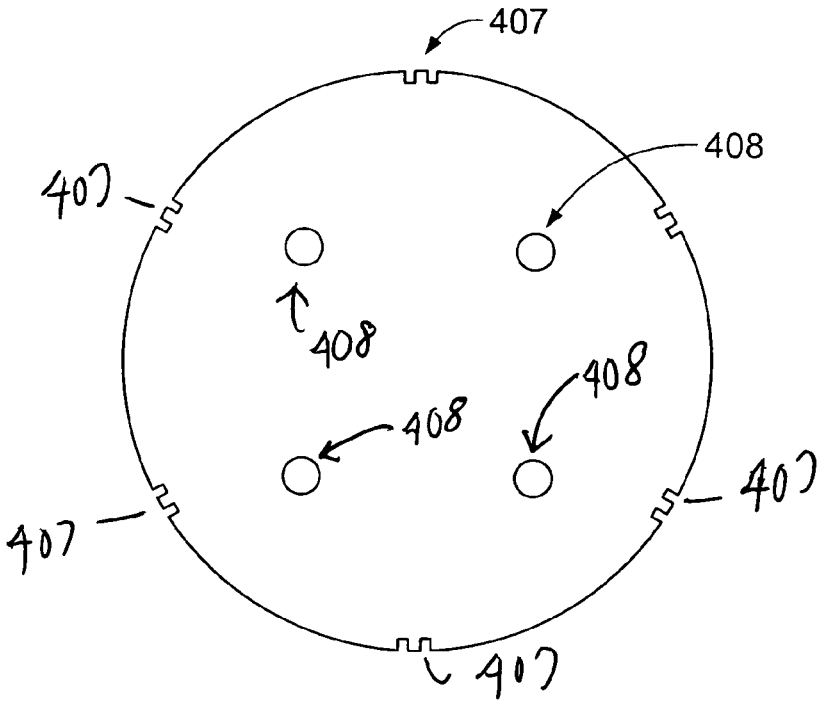
FIG. 6B is a bottom plan view of the inner support of FIG. 6A.
Figure 7A:
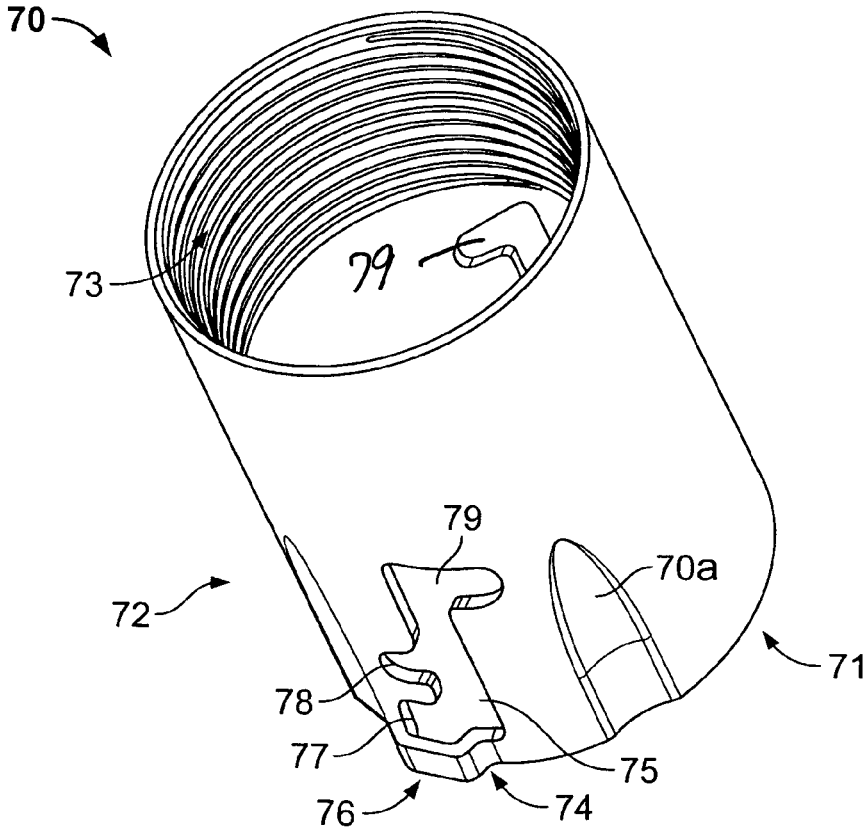
FIG. 7A is a perspective view of an adjustable cap made in accordance with the teachings of the present invention.
Figure 7B:
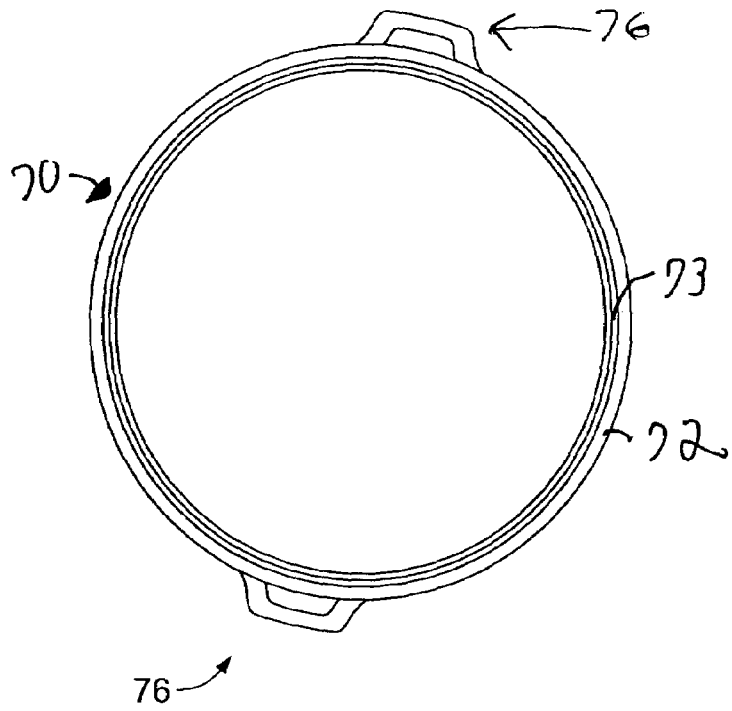
FIG. 7B is plan view of the adjustable cap of FIG. 7A.
Figure 8:
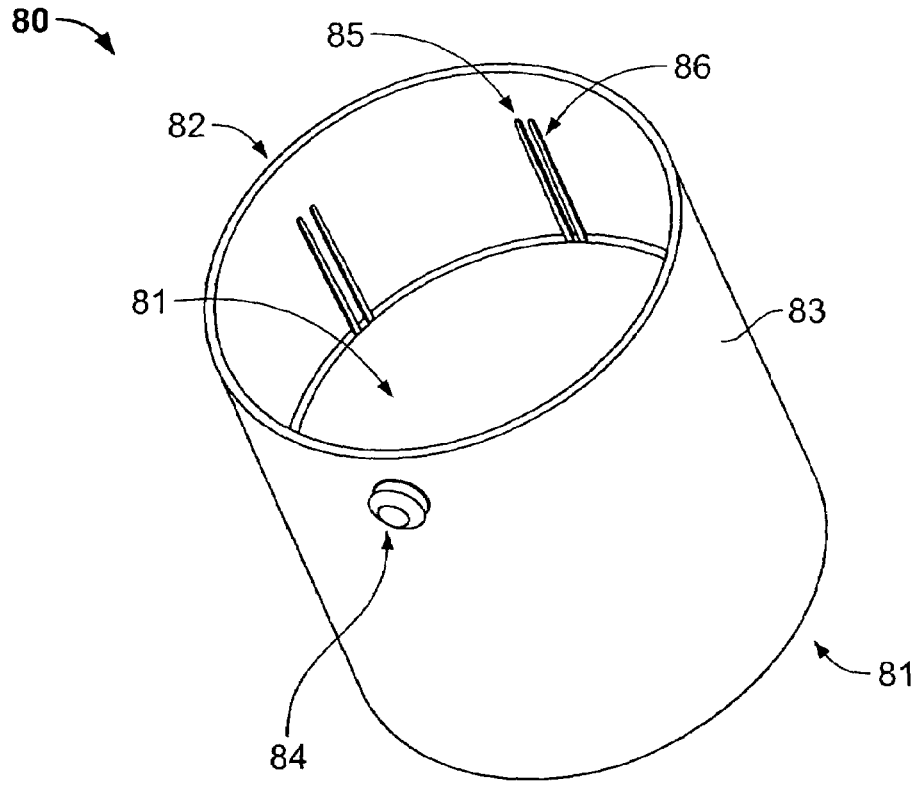
FIG. 8 is a perspective view of a step-adjust cap made in accordance with the teachings of the present invention.
Figure 9:
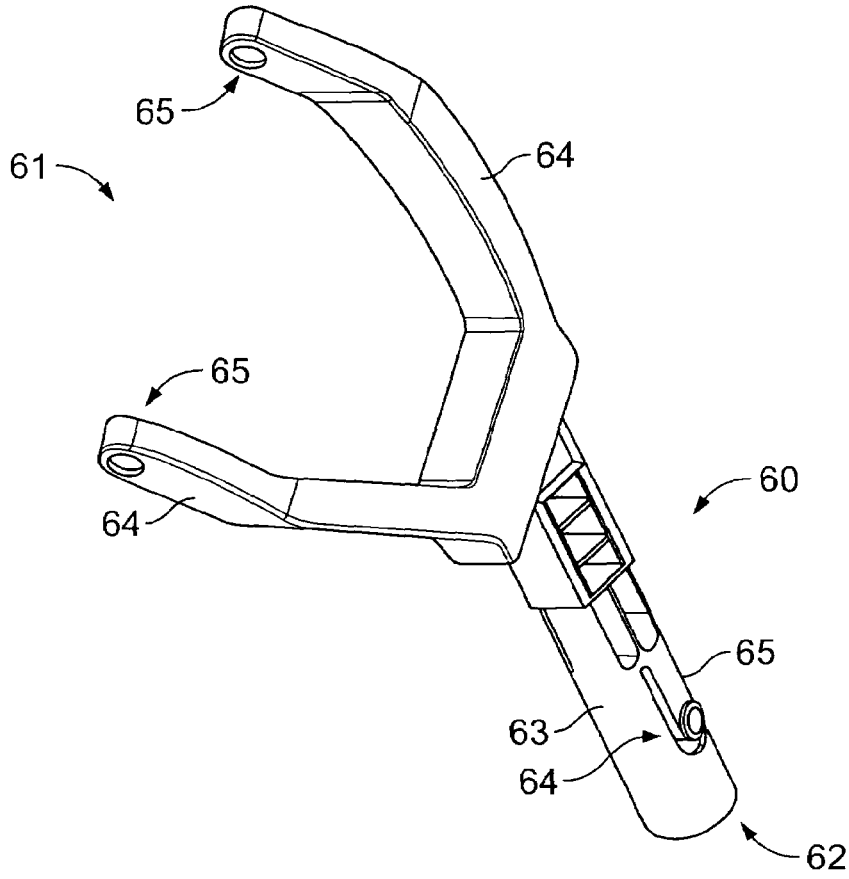
FIG. 9 is a perspective view of a handle made in accordance with the teachings of the present invention.
Figure 10:
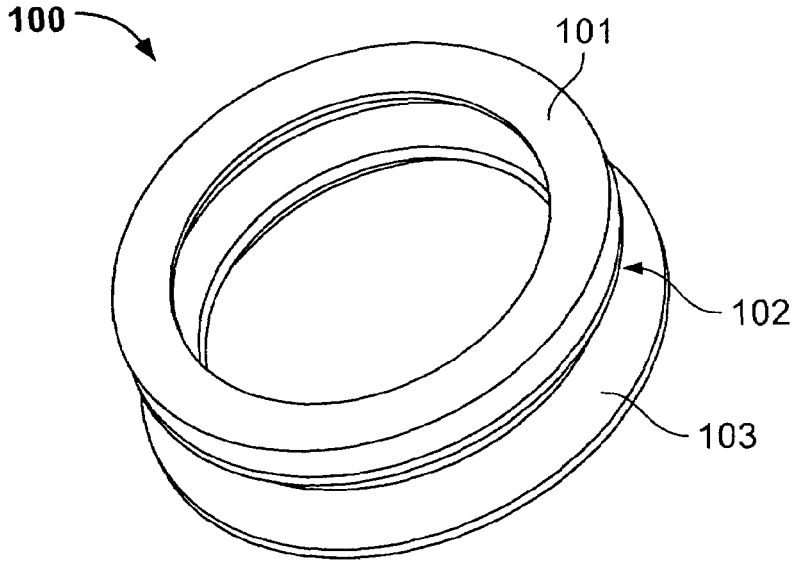
FIG. 10 is a perspective view of an internal elastomeric ring made in accordance with the teachings of the present invention.
Figure 11A:
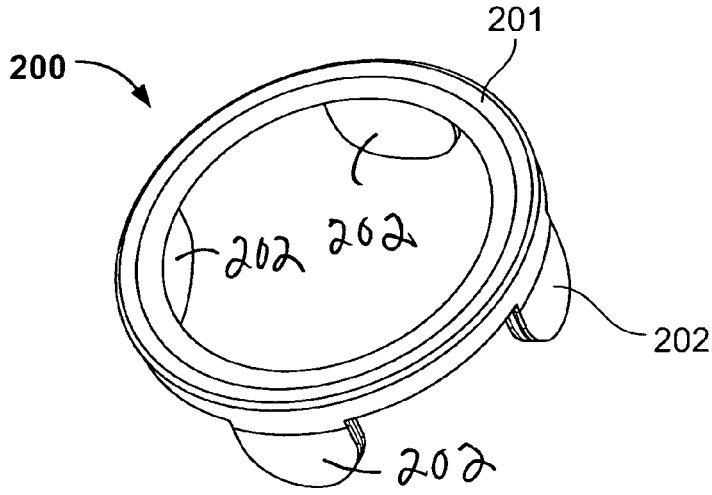
FIG. 11A is a perspective view of an external elastomeric ring made in accordance with the teachings of the present invention.
Figure 11B:
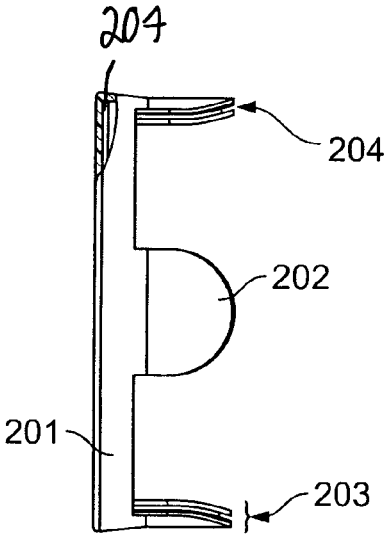
FIG. 11B is side view of the external elastomeric ring of FIG. 11A.
Figure 11C:
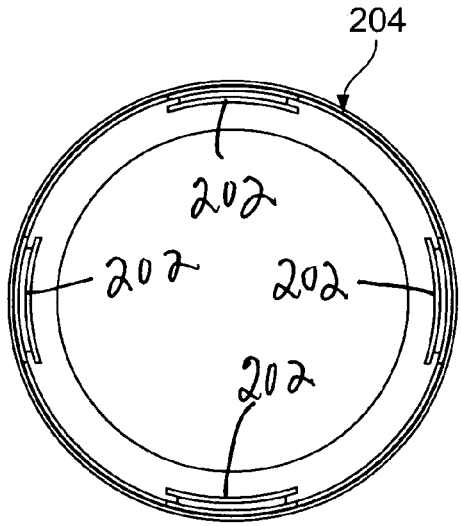
FIG. 11C is bottom plan view of the external elastomeric ring of FIG. 11A.
Figure 12:
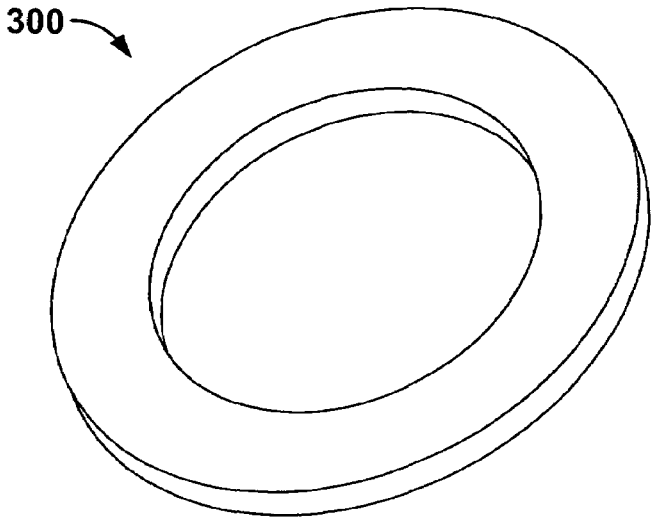
FIG. 12 is a perspective view of a second internal elastomeric ring made in accordance with the teachings of the present invention.

Referring now to FIGS. 4A and 4B, the mid-cap 40 has external threading 43 at one end 42 and a bell-shaped open cone 44 at the other end 41 for permitting the chamber 30 to slide downwardly therein when the operator presses the rim 34 against the ceiling or wall 2 during the test procedure for releasing the testing material within the aerosol canister 8 when the cage area 39*a* of chamber 30 engages an actuator cap 8*a* on the aerosol can 8. A plurality of posts 45 projecting annularly from the base 47 (adjacent a base opening 49) cooperates with the hollow posts 37 in the chamber 30 by extending through the hollow posts 37 a predetermined distance above the distal end of the hollow posts 37. The portion 45*b* of the posts 45 extending above the end of posts 37 includes a spring 45*a* around the portion 45*b* of each post 45 and terminates with a washer 45*d* and fastener 45*e* screwed into an opening 45*c* at the distal end of each post 45 to hold the spring 45*a* in various states of compression between the washer 45*d* and the distal end of the posts 37 to assist in the release of the testing material in the canister 8. Opposed pivot pins 46 project outwardly from the outer surface of the cone 44 to cooperate with the handle 60.

The Support Ring 50

The support ring 50 is used to interconnect the mid-cap 40 to the chamber 30. The ring 50 has a substantially planar base 51 and a plurality of hollow posts 52, 53 of alternating heights. The hollow posts 52 accept and cover the posts 45, spring 45*a*, portion 45*b*, washer 45*d* and fastener 45*e* of the mid-cap 40 (posts 45 extending through the holes 39 and passage 49*c* in posts 37 into the chamber 30), which components accept and hold the springs 45*a* in a state of compression between the washer 45*d* and the distal end of posts 37 of the cup/chamber 30. In this manner the chamber 30 connects to the mid-cap 40 in an axially guided and slidable relationship with respect to one another. The support ring 50 further includes the shorter posts 53 located midway between each post 52 having an opening 53*a* on the planar base 51 leading to a fastener passage 53*b* therethrough for receiving a screw fastener 53*c* having its threads extend below each post 53 for threading the screw 53*c* into the openings 37*b* of each post 37*a*. This threaded connections between the posts 53 and the posts 37*a* firmly connects the ring 50 to the cup 30. The posts 37 and 45 having post 45 extending through and above posts 37 the predetermined distance of portion 45*b* with the compressed spring 45*a*, stop washer 45*d* and screw 45*e* attaching the washer in a fixed position to the top of posted 45, connect the cup 30 and mid-cap 40 in an axially slidable relationship with respect to one another for aiding in the setting of the release point of the testing material from the canister 8 to be described in greater detail later.

It should be noted that springs 45*a* are placed around the portion 45*b* of the posts 45 of the mid-cap 40 to permit slidable movement between the mid-cap 40 and cup 30 in an axial direction to one another. Thus, by inserting a canister 8 within the step-adjust cap 80 and adjusting it to a point just before testing material is released, the springs 45*a* are compressed as the cup 30 extends axially upward from the mid-cap 40 a predetermined adjustment distance. Then by pushing the rim 34 of the cup 30 against a wall or ceiling, the cup moves axially downward relative to the mid-cap 40 (releasing spring compression) to activate the actuator 8*a* on the aerosol can 8 therein. The posts 37 of the cup 30 receiving the post 45 through their hollow passageway 39*c* act as annular guides for the axial movement between the cup 30 and mid-cap 40 while the tension of each spring 45 is being compressed and then released during the testing operation of the apparatus 10.

The Inner Support 400

The inner support 400 includes a base 401 with concentric tubes 402, 403, radial fins 404 and an internal cross 405. The base's perimeter 406 includes notches 407 therein and the base has holes 408 therein. The base 401 is positioned to abut the base 81 of the step-adjust cap 80 with the fins facing upward and the notches engaging a pair of parallel and corresponding flanges or ridges 85 and 86 on inner wall of the step-adjust cap 80 to hold the inner support in a fixed position within the cap 80. The support 400 with its concentric tubes 402 and 403 holds or supports the testing material, namely an aerosol can or canister 8 having different base diameters. The design of the support 400 permits the holding of canisters of different sizes, for example, such as 4½ oz. and 10 oz cans within the holding tubes 402 and 403, respectively, from the previously mentioned source for test canisters.

Thus, as the canister 8 is situated on the inner support 400 within either concentric selected tube 402 or 403 and the adjustable cap 70 is moved upwards relative to the mid-cap 40 by twisting on the threading, the aerosol top actuator 8*a* on the canister is activated. The adjustable cap is then rotated back to stop the aerosol test material from being released. At this point the detector is ready for use and the springs 45*a* are slightly compressed moving the cup 30 axially upward and biased away from contact with the sides of the opening 41 of the mid-cap 40. By pushing the rim 34 of the cup 30 against a wall or ceiling, the cup 30 moves axially and downwardly toward the mid-cap 40 whereby the aerosol top or actuator 8*a* is activated by cage area 39*a* on the cup 30 to releases the aerosol testing material within the chamber 30 surrounding the detectors 1 or 22.

The Adjustable Cap 70

The adjustable cap 70 has internal threading 73 at one end 72 and a bayonet mount 74 at the other end 71. The bayonet mount 74 permits the step adjust cap 80 to attach to the adjustable cap 70. The internal threading 73 mates with the external threading 43 of the mid-cap 40 to hold those two components together defining the holder 4 for the canister 8 therein. This connection permits one to easily screw the adjustable cap 70 holding the step-adjust cap 80 to the mid-cap 40.

The bayonet mount 74 includes opposed central longitudinal slots 75. Each longitudinal slot 75 has a bridge 76 crossing it and angled tributary channels 77, 78, 79 projecting therefrom. Finally, a plurality of depressions 70*a* is constructed into the walls of the adjustable cap 70 for gripping the adjustable cap 70 when screwing the adjustable cap 70 onto the mid-cap 40 for the proper operation of the particular sized aerosol canister 8 being used within the apparatus 10.

The Step Adjust Cap 80

The step adjust cap 80 is a closed receptacle, having a closed end 81 and an open end 82. Opposed external pins 84 projecting outwardly from the sidewall 83 cooperate with the longitudinal slots 75 in the adjustable cap 70. The pins can slide under the bridges 76 into the slots 75 and into any of the three tributary channels 77, 78, 79 provided. Placement of and locking a pin 84 in each tributary channel 77, 78, 79 changes the distance between the base 81 (and anything, such as an aerosol can 8, supported on the base) of the step-adjust cap 80 and the cage area 39*a* of the chamber or cap 30.

Internal pairs of flanges 85, 86 are further provided to hold the radial fins 404 of the internal support 400 thereinbetween. Consequently, the base 401 of the inner support 400 is positioned to abut the base 81 of the step-adjust cap 80 with the fins facing upward. The support 400 holds or supports the testing material, namely an aerosol can or canister 8 of a predetermined diameter and size. As a result, aerosol canisters 8 of different sizes, such as 4½ oz. and 10 oz., can be used in the apparatus. One is thus not limited to a particular brand, manufacturer and/or size of canisters for the test.

Placing the aerosol test canister 8 on the support 400, into the cap 80 and locking the cap 80 relative to the adjustable cap 70 places the canister in proper position for activation.

The Handle 60

The handle 60 has a pole supporting portion 63 at one end 62 and extending arms 64 at the other end 61. Each extending arm 64 has an aperture 65 therein for receiving the pins 46 projecting outwardly from the outer surface of the cone 44 section of the mid-cap 40. As a result, the handle 60 can rotate relative to the mid-cap 40 and the attached chamber 30.

The pole-supporting portion 63 is tubular, or hollow, and has a U-shaped cutout 64 therein so as to permit a button section 65 to cooperate with an extension pole 9 or telescoping pole (not shown).

The Internal Elastomeric Ring 100

The internal ring 100 is rubber or an elastomeric. It has a base 101, central depression 102 and flair 103. The base 101 is secured adhesively to the material end 33 of the chamber 30 beyond the base 36. This internal ring 100 generally seals against the top surface of the aerosol can so that when the actuator 8*a* is depressed releasing the test material, the test material is then directed through the opening in the cage area 39*a* into the hollow of the test chamber 30 surrounding the detector to be tested rather than escaping downwardly into the holder cavity formed by the adjustable cap 70 and step adjust cap 80 causing an inefficient use of the testing material. The ring 100 also acts to bias the cup 30 axially upward from the mid-cap 40 as the ring 100 collapse around the top of the aerosol can 8 to seal around the top of the canister when adjusting the components 30, 40, 70 and 80 to activate the canister 8. Now when the rim 34 of cup 30 is pressed against a wall or ceiling, the cage area 39*a* moves axially downward against the actuator 8*a* of the canister 8 releasing the test material therein.

The External Elastomeric Ring 200

The external elastomeric ring 200 includes a base ring 201 and a plurality of legs 202. The entire inner surface 203 includes a channel 204. The legs 202 cover the notches 35 in the chamber 30. The channel 204 is used to hold or frictionally engage the distal end, or rim 34 of the chamber 30. The frictional engagement between the rim 34 with notches 35 and the perimeter channel 204 of the ring 200 is such that one can easily remove all or part of the ring 200 from the distal end and then reapply it when desired. In addition, the ring 200 is constructed of deformable elastic material such that when the rim 34 is pressed against a ceiling 2 over electrical conduit, the electrical conduit recesses into the notches 35 of the cup 30 with the elastic material sealing the entrance and exit by the conduit into the testing chamber 30.

The Second Internal Elastomeric Ring 300

Internal second rings 300 are provided to act as gaskets or seals between components such as around each post 37 and against the distal end of each hollow post 52 on support ring 50 to seal within hollow post 52 the axial movement of the posts 45 of the mid-cap 40 within the posts 37 of the cup 30 from the testing material within the chamber 30.

Further Developments and Attributes

FIG. 13 shows another important feature of the present invention is the inclusion of a Universal Product Code ("UPC") reader mounted either on the handle 5 or on the pole 9 so the operator testing a particular detector can identify each detector in a large facility, such as a building having multiple detector units installed therein. Bar code scanners can be built using laser or LED-based phototransistor circuits. In the case of a LED UPC reader, the LED or laser lights the barcode, which absorbs the light or reflects back to the light-sensitive transistor. In the present invention, a LED-based system or UPC reader and Personal Digital Assistants ("PDAs") combination 500 with wireless communication capability is one of many devices that may be used because they are reliable and readily available. PDAs are essentially handheld computers enabling them to be used as data manipulating devices with attendant software programs, mobile phones or web browsers that can send and receive data by accessing the Internet, intranets or extranets via Wi-Fi or Wireless Wide-Area Networks ("WWANs"). Therefore, the UPC reader/PDAs 500 is only dependent on the local phone service or the Wi-Fi or WWANs services available or it may even incorporate its own RF signal that transmits to a central location. One of the limitations to a phototransistor system (bar code) is it is very distance sensitive in reading the bar code, so the UPC reader/PDAs 500 is mounted on the handle 5 or pole 9 of the apparatus 10 to place a wand-end 508 of the UPC reader/PDAs 500 in a close proximity to a bar code 510 on the detector 1. In addition, the wand-end 508 of the UPC reader/PDAs 500 is mounted at an angle of approximately 30 degrees or more so that the chamber 30 does not interfere with the reading of the bar code 510 on the detector 1. An angle of approximately thirty degrees (30°) or more is generally an appropriate separation from the chamber 30 to read the typical bar code marking on the detector mounted on a high wall or ceiling 2. The UPC reader/PDAs 500 may incorporate the latest cell phone technology or other communication technology like Blue Tooth to permit the bar code information to be downloaded wirelessly through the PDAs circuitry to a central location like a host computer 512 for the system with appropriate software to confirm and to record the identity of the detector tested and whether it passed the test or not.

The UPC reader/PDAs 500 is mounted to the handle 5 or poles 9 by a bracket 502 including a clamp 504 and a carrier platform 506 affixed to the clamp 504. A carrier platform 506 removably affixes the UPC reader/PDAs 500 to the tester handle 60 or poles 9 so that the testing operator can wave the wand-end 508 of the UPC reader/PDAs 500 across the detector bar code marking 510 to read its UPC code and thereby properly identifying the detector being tested and then transmit the identification and whether it passed the test to a central location like a computer system 512.

Moreover, the detectors 22 as shown in FIG. 14 can incorporate a passive or active RFID chip 514 mounted on each detector 22 to provide the identification means for each detector within a building. In that case, a RFID receiver/PDAs 516 may be attached to the handle 60 or poles 9. The operator can also carry the RFID receiver/PDAs 516 in the RFID system in a convenient location like a pocket on their person since the distance from the smoke detector is not often critical when using radio frequencies rather than the LED based system. Again, the RFID receiver/PDAs can incorporate Blue Tooth technology or other similar cellular phone technology to quickly and wirelessly transmit the information about each detector to the central location such as the main computer 512 that retains all of the test information including pass and fail data about each detector.

Turning now to FIG. 13, a smoke or carbon monoxide detector 1 attached to the ceiling 2 has the UPC reader/PDAs 500 mounted on the pole 9 sensing a bar code marking 510 on the exterior of the detector 1. The operator simply waves the pole 9 with the UPC reader/PDAs 500 with its wand-end 508 back and forth in close proximity of approximately 6" to 8" inches from the bar code marking 510 to read the bar code 510 and identify the detector 1 being tested. The UPC reader/PDAs 500 is securely affixed to the bracket 502 with a Velcro® strip and strap 518. The UPC reader/PDAS 500 also may incorporate a microprocessor and wirelessly communication circuitry separate from the PDA/cell phone technology to communicate wirelessly with the central location or host computer 512 to provide storage for the recordation of each detector that had been tested and the results of each test.

Also, shown in FIG. 13 is a canister 8 of approximately 4½ ounces of testing material held within an adjustable holder chamber 520 comprised of the step adjust cap 80 and adjustable cap 70. Arrows 522 adjacent either side of the chamber 30 and mid-cap 40 of the apparatus 10 show the testing rim 34*b* of the testing chamber 30 engaging the ceiling 2 and when the operator pushes the rim 34*b* of the chamber 30 against the ceiling 2, the chamber 30 slides axially downward into the opening 41 of the mid-cap 40 causing an actuator 8*a* on the canister 8 to be depressed by cage area 39*a* thereby releasing the testing materials within the canister 8 into the test chamber 30 to complete the testing of the detector 1. The previously described seal 100 mounted on the cage area 39*a* and sealing against the top portion of the canister 8 prevents the backflow of testing material into adjustable holder chamber 520 during the release of the testing material. Meanwhile, the operator can either manually or automatically depending upon the circuitry and software within the UPC reader/PDAs 500 send the information identifying the detector 1 being tested and the test results via wireless communication signals 534 and 536, respectively. The first signal 534 is the bar code 510 information of the detector 1 transmitted to the UPC reader/PDAs 500. The second signal 536 is the data of the identification and/or the test results from the UPC reader/PDAs to the central location or host computer 512 collecting the information from the conducted tests.

In addition, there is a potential for an automatic mode for either the UPC reader/PDAs 500 or RFID receiver/PDAs 516 when using the sophisticated PDAs with their powerful microprocessors and cell phone circuitry of today. The UPC reader/PDAs 500 and the RFID receiver/PDAs 516 can both incorporate sound detection circuitry (not shown) and when the detectors 1 or 22 are being tested, the detectors give off beeps with the typical high pitched piezo-electric alarm horn incorporated typically within the detectors, which is a very loud and easily detectable high decibel level sound signal 530 for all known smoke and carbon monoxide detectors. The UPC reader/PDAs 500 and RFID receiver/PDAs 516 with their sound detection circuitry upon detecting the sound waves 530 of the detector wirelessly transmits the positive or negative (lack of sound) results of the testing to the host computer 512 for recording the data and test results for each detector being tested.

FIG. 14 shows essentially the same configurations as previously described for FIG. 13 with a few important differences. First, a larger testing chamber 20 is shown having a generally inverted bell or frustum cone shape with two ends 23 and 25. The smaller end 25 includes a lower opening 25*a* with a rim 25*b* approximately the same size as the rim 34*b* of the smaller chamber 30 and the distal and larger end 23 includes an upper opening 23*a* with a rim 23*b* defining the substantially larger opening 23*a* than the lower opening 25*a* for testing a larger detector 22. The distal end 23 includes the same designed notches 35 for accommodating conduit of different sizes typical connecting electrical power to larger detectors 22. The rim 23*b* and notches 35 might also be covered by an elastic ring 200*a* of the same material and design as the elastic ring 200 for the chamber 30 and its rim 34*b* but just larger in size. This larger testing chamber 20 may have its rim 25*b* clip onto the existing rim 34*b* and notches 35 of chamber 30 in place of its elastic external ring 200. Although, the larger testing chamber 20 could also be in combination with an generally stiffer elastic material converter 24 attaching to the rim 34*b* of the smaller chamber 30 and covering the notches 35 in rim 34*b* similar to previously described above for the elastic external ring 200 and of a similar material but slightly stiffer than ring 200 whereby the converter 24 having an upwardly facing annular channel within its planar base surface therein, which receives the rim 25*b* in a snap fit and stable relationship on its top surface so the apparatus 10 with the extender chamber 20 can also be pressed up against the wall or ceiling 2 over the detector 22 to form a sealed chamber for testing in a closed delivery system. Next, the pressing of the rim 23*b* against the ceiling or wall causes the joined chambers 20 and 30 to slide axially downward together into the opening 41 of the mid-cap 40 activating the actuator 8*a* on the aerosol canister 8 and releasing the testing material within the sealed testing chamber 20 and 30 combined. Releasing some of the pressure against the rim 23*b* on the wall or ceiling 2 causes the springs on posts 45 to move the chambers 20 and 30 back their original positions, which turns off the actuator 8*a* on the canister 8. In FIG. 14, the step adjust cap 80 is located in the bottom notch 77 so the larger 10 oz. canister can be used to test the larger detector 22. The larger testing chamber 20 is made of the same translucent plastic type material as the smaller chamber 30 to permit the operator to view testing material being released around the detector 22 during set-up, testing and removal of the apparatus 10.

Further, the detector 22 in FIG. 14 including the RFID tag 514 is able to store pertinent testing information on an active tag about its last date of testing or other important details about a particular detector. The RFID receiver/PDAs 516 can be mounted on the pole 9 or any other convenient location on the apparatus 10 since the sensing distance generally depends on whether the RFID tag 514 is active or passive. The RFID receiver/PDAs 516 is held in a pouch or holster 526 similar to those for holding PDAs, car phone or the like. Each PDAs or cell phone have holsters designed for the particular PDAs being used but holster 34 could also be one of the universal holsters that accommodate many different PDA(s) or cell phone(s) housings. Generally, the holster 526 securely holds the UPC reader/PDAs 500 or the RFID receiver/PDAs 516 so the movements by the operator with the poles 9 or handle 60 will not dislodged the reader and/or receiver/PDAs, which are held by the same bracket 502 on the pole 9 or attached to the handle 60 of the apparatus 10. An active RFID tag 514 can be located some distance from the chambers 20 and 30 because the radio frequency signal generated is capable of carry over a distance of several hundred feet from the detector being tested. On the other hand, a passive RFID tag 514 requires the RFID receiver/PDAs 516 to be brought generally in a closer proximity to the tag 514 but again the sensing distance between the passive RFID tag 514 and its receiver/PDAs 516 is still generally greater than any distance offered by the bar code system. Again, the RFID receiver/PDAs 516 could incorporate the same or different sound detecting features as the UPC reader/PDAs 500. Then the identification signal 534 and test results are similarly communicated wirelessly to the host computer 512 via signal 536 in either the manual or automatic mode as described above. One additional feature of an active RFID tag is that such a tag can also provide both identification and sound detection of passing the test directly to the host computer 512 with the transponder on RFID tag.

In the manual mode of each reader or receiver/PDAs 500 and 516, the default is that the detector passes the test. If the horn does not sound and it fails the test, then the operator manually enters this data into the reader or receiver/PDAs for transmission to the host computer 512. The reader and receiver/PDAs can also process other information. For example, it can work with various prompts wherein the operator answers a series of questions regarding the testing of the detectors 1 or 11.

Another useful feature is that the UPC reader and RFID receiver/PDAs 500 and 516, respectively, are attached to the pole 9 of the apparatus 10 allowing a simple collection of the testing information about each detector. If there is more than one operator, the reader or receiver/PDAs could be attached to a separate pole all by itself and the two operators can work together during the testing phase of the detectors. Although, the UPC and RFID reader and receiver/PDAs are shown attached to this particular apparatus of the present invention, it can be easily adaptable to be used with other existing pole testing devices for open delivery systems.

In addition, the step adjustment cap 80 when its pin 84 is locked in the bottom notch 77 of the adjustable cap 70, extends the size of the canister 8 in ghosted lines that can be held in the chamber formed by interiors of the mid-cap 40, the adjustable cap 70 and the step adjustable cap 80. In the example as shown in FIG. 14, a 10 ounce aerosol can 8 having a larger volume of testing material is held within the chamber formed by the mid-cap, adjustable cap and the step adjust cap for testing the larger detectors 22.

Moreover, both FIGS. 13 and 14 shows the apparatus 10 in the test mode where it is releasing testing material or substance 528 surrounding the detectors 1 and 22, respectively. The bar code 510 is read by the UPC reader/PDAs identifying the detector 1 or if an RFID tag is used then RF signal from the tag 514 with identifying information is received by the RFID receiver/PDAs 516 in its holster 526. The testing material 528 can cause both detectors 1 and 22, not only detector 22, to give off sound waves 530 from their piezo-electric horns within the detectors and a flashing a red light indicator 532 at the same time. Meanwhile, the sound is picked up by the UPC reader/PDAs 500 or the RFID receiver/PDAs 516 indicating a successful test and the PDAs wirelessly transmits the results of the test in the automatic mode to the central location or host computer 512.

While the specific embodiments have been illustrated and described, it is recognized numerous modifications can be made without significantly departing from the spirit of the invention. Accordingly, the scope of protection is only limited by the scope of the accompanying Claims.

What is claimed is:

1. An apparatus for testing smoke and carbon monoxide detectors mounted at an elevated location above a ground surface, comprising:

a testing chamber adapted to fit over the detector to provide an enclosed delivery system during the testing of the detector;

a holder connected in a spring cooperating relationship to the testing chamber for containing and releasing the test materials as the testing chamber slides downwardly toward the bottom of the holder when pressed against a wall or ceiling;

a handle pivotally attached to the testing chamber for pressing the testing chamber against a wall or ceiling over the detector to be tested;

wherein the testing chamber has a distal end or rim defining an opening and including opposing notches having a flexible and sealable material covering the distal end or rim and the opposing notches, the flexible material deforming within the notches when placed over at least one electrical conduit communicating with the detector being tested to form a seal around the conduit extending into the testing chamber.

2. The apparatus of claim 1, wherein the testing chamber is generally bell shaped at the distal end or rim that is pressed against the wall or ceiling and sealably connected to the holder at the other end, the distal end is open to receive the detector therein.

3. The apparatus of claim 1, further including a rigid extension of a predetermined length removably affixed to the handle for elevating the testing chamber to cover detectors mounted at elevated heights above the floor surface of a building.

4. The apparatus of claim 1, wherein the holder is capable of incorporating canisters of different sizes housing the test materials.

5. The apparatus of claim 4, wherein the testing chamber flexes with respect to the holder when pressed against the wall or ceiling to operate the canisters into releasing the testing materials.

6. The apparatus of claim 1, further comprising an identifier device mounted in proximity to a distal end of the testing chamber for sensing an identification marking associated with each detector to be tested.

7. The apparatus of claim 6, wherein the identifier device is a bar code reader and the identification marking on the detector is a bar code or UPC marking and wherein the identifier device includes wireless communication circuitry for transmitting detector identification and testing results to a central location for recordation of each detector tested.

8. The apparatus of claim 6, wherein the identifier device is a RFID receiver and the identification marking is a RFID tag with a transponder on the detector and wherein the device include wireless communication capability for sending detector identification and testing results from the RFID receiver to a host computer for recordation of the test data from each detector.

9. An apparatus for testing smoke and carbon monoxide detectors having an identifier within a closed delivery system, the detector being mounted at an elevated location above a ground surface, comprising:

a generally cone shaped testing chamber of a translucent material to view the testing;

a handle for elevating the testing chamber to an elevated detector on a wall or ceiling;

a mid-cap having external threading at one end and a bell-shaped open cone at the other end for permitting the chamber to slide therein, the mid-cap having a plurality of posts extending upwardly toward the chamber and having pivot pins projecting outwardly from the outer surface of the cone to cooperate with the handle;

a support ring interconnecting the mid-cap to the chamber having hollow posts of alternating heights corresponding and accepting the posts from the mid-cap in a slidably engaging manner;

springs positioned around the posts of the mid-cap to permit slidable movement between the mid-cap and chamber;

an adjustable cap having internal threading at one end and a bayonet mount at the other end, the internal threading mates with the external threading of the mid-cap to hold the adjustable cap and mid-cap together in a predetermined relationship; the bayonet mount includes opposing central longitudinal slots, each longitudinal slot having a bridge crossing it and angled tributary channels projecting therefrom;

a step adjust cap having a closed end and an open end with opposed external locking pins projecting outwardly from its external side wall to cooperate with the longitudinal slots in the adjustable cap, the adjust cap having a holder for receiving an aerosol canister of different sizes and heights having an actuator on top of the canister for releasing test material inside the canister, the locking pins sliding under each bridge into the slots and the placement of the locking pin in each tributary channel changes the distance between the closed end of the step adjust cap and the test chamber to accommodate the canister of different sizes supported in the holder within the step adjust cap; and, wherein the chamber slides axially downwardly into the mid-cap when the distal rim of the chamber is pressed against a wall or ceiling, the chamber having a cage area whereby the axial movement causes the cage area of the test chamber to engage an actuator on top of the aerosol canister thereby releasing the aerosol testing material therein for the test.

10. The apparatus of claim 9, further including a sensor for detecting the identifier on each detector and for detecting the alarm sound emitting from the detector when the test materials are released within the chamber, the detection sensor having circuitry to wirelessly transmit the identification and test results data to a central location for recordation of the testing results for each detector that is tested within the closed delivery system.

11. The apparatus of claim 9, further including opposed cutouts on the distal end or rim of the chamber for accepting different size electrical conduit communicating with the detector.

12. The apparatus of claim 11, further including a rubber or elastic material covering the rim and cut-outs of the chamber to seal the chamber when pressed against the wall or ceiling around the detector and its communicating conduit within the cut-outs.

13. The apparatus of claim 11, further including a second cone shaped extender chamber having a greater diameter than the chamber and having two ends, one end of the extender chamber having an opening and a rim slidably engaging and snap fitting over the distal end or rim of the chamber to form a larger testing chamber for larger detectors, the other end or distal end of the extender chamber having an opening for receiving the detector.

14. An enclosed delivery tester for testing smoke and carbon monoxide detectors mounted at an elevated location above a ground surface, the enclosed delivery tester comprising:

a testing chamber adapted to fit over the detector to provide an enclosed delivery system during the testing of the detector;

a holder connected in a spring cooperating relationship to the testing chamber for containing and releasing the test materials as the testing chamber slides downwardly toward the bottom of the holder when pressed against a wall or ceiling;

a handle attached to the testing chamber for pressing the testing chamber against a wall or ceiling over the detector to be tested; and an identifier device fixed to the enclosed delivery tester proximate the testing chamber wherein the identifier device undergoes simultaneous elevation as the testing chamber is elevated to a mounted detector.

15. The enclosed delivery tester of claim 14, wherein the identifier device is a bar code reader for reading a bar code or UPC marking on an elevated mounted detector.

16. The enclosed delivery tester of claim 15, wherein the identifier device includes wireless communication circuitry for transmitting detector identification and testing results to a central location for recordation of each detector tested.

17. The enclosed delivery tester of claim 14, wherein the identifier device is a RFID receiver of receiving and RF signal from the elevated mounted detector.

18. The enclosed delivery tester of claim 17, wherein identifier device includes wireless communication capability for sending detector identification and testing results from the RFID receiver to a host computer for recordation of the test data from the detector.

19. An enclosed delivery tester for testing smoke and carbon monoxide detectors mounted at an elevated location above a ground surface, the enclosed delivery tester comprising:

a testing chamber adapted to fit over the detector to provide an enclosed delivery system during the testing of the detector;

a canister holder attached to the testing chamber in a spring cooperating relationship thereto wherein the testing chamber is spring-biased towards the canister holder; and a handle joined to the testing chamber for pressing the testing chamber against a wall or ceiling over the detector to be tested.

20. The enclosed delivery tester of claim 19 further comprising a threaded attachment between a first portion of the tester and a second portion of the canister holder, wherein the threaded attachment is provided for drawing the canister actuator against a portion of the chamber.

* * * * *